US010720289B1

(12) United States Patent
Ho et al.

(10) Patent No.: US 10,720,289 B1
(45) Date of Patent: Jul. 21, 2020

(54) LIGHT EMITTING KEYBOARD AND LIGHTING BOARD THEREOF

(71) Applicant: DARFON ELECTRONICS CORP., Taoyuan (TW)

(72) Inventors: Hsin-Cheng Ho, Taoyuan (TW); Heng-Yi Huang, Taoyuan (TW); Tsai-Yu Chen, Taoyuan (TW); Hung-Chuan Cheng, Taoyuan (TW); Yang-Cheng Wu, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/553,145

(22) Filed: Aug. 27, 2019

(30) Foreign Application Priority Data

Feb. 20, 2019 (TW) ..... 108105589 A

(51) Int. Cl.
*H01H 13/83* (2006.01)
*H01H 13/88* (2006.01)
(Continued)

(52) U.S. Cl.
CPC ..... *H01H 13/88* (2013.01); *H01H 3/12* (2013.01); *H01H 13/7065* (2013.01); *H01H 13/83* (2013.01)

(58) Field of Classification Search
CPC ..... H01H 13/83; H01H 2219/062; H01H 13/023; H01H 2219/036; H01H 9/161; H01H 15/025; H01H 23/025; H01H 3/125; H01H 13/70; H01H 13/705; H01H 1/0206; H01H 1/023; H01H 11/048; H01H 1/02376; H01H 1/0237; H01H 1/02; H01H 1/0233; H01H 11/041; H01H 1/021; H01H 1/0231;
(Continued)

(56) References Cited

U.S. PATENT DOCUMENTS 7,841,791 B2 * 11/2010 Iso ..... G06F 1/1616 400/472
8,383,971 B2 2/2013 Liu
(Continued)

FOREIGN PATENT DOCUMENTS

CN 101193472 A 6/2008
CN 105185632 A 12/2015
(Continued)

*Primary Examiner* — Ahmed M Saeed
(74) *Attorney, Agent, or Firm* — Winston Hsu

(57) ABSTRACT

A light emitting keyboard includes a bottom board, keyswitches, and a lighting board. The lighting board is disposed between the bottom board and the keyswitches or under the bottom board and includes a flexible substrate having a first hole, multiple-light emitting diodes corresponding to the keyswitches, first and second silver-paste circuit layers formed on upper and lower surfaces of the flexible substrate respectively, a via pillar formed in the first hole to be coupled to the first and second silver-paste circuit layers, a copper layer plated on the first and second silver-paste circuit layers, and a first protection layer coated on the copper layer and having second holes. Each multiple-light emitting diode is disposed on the copper layer plated on the first silver-paste circuit layer through the corresponding second hole to be coupled to the first silver-paste circuit layer.

50 Claims, 11 Drawing Sheets

(51) Int. Cl.
*H01H 3/12* (2006.01)
*H01H 13/7065* (2006.01)

(58) Field of Classification Search
CPC ..... H01H 1/02372; H01H 1/025; H01L 2924/0105; H01L 2924/0132; H01L 2924/0133; H01L 2924/01029; H01L 2924/01047; H01L 2924/0103; H01L 2924/01079; H01L 2924/01028; H01L 2224/73265; H01L 2224/48227; H01L 2924/014
See application file for complete search history.

(56) References Cited

U.S. PATENT DOCUMENTS

2009/0103964 A1* 4/2009 Takagi ..... H01H 3/125 400/495
2010/0038226 A1 2/2010 Lin
2011/0042124 A1* 2/2011 Matsui ..... H05K 3/4632 174/157
2011/0186340 A1* 8/2011 Kuramoto ..... H01L 24/83 174/260
2012/0138990 A1* 6/2012 Sato ..... H01L 33/641 257/98

FOREIGN PATENT DOCUMENTS

| | | | |
|---|---|---|---|
| CN | 107818884 | A | 3/2018 |
| EP | 1 775 742 | B1 | 12/2008 |
| TW | M443218 | U1 | 12/2012 |
| TW | M478318 | U | 5/2014 |
| TW | 201503195 | A | 1/2015 |
| TW | M546017 | | 7/2017 |
| TW | M547130 | U | 8/2017 |
| TW | 201743363 | A | 12/2017 |
| TW | I611449 | B | 1/2018 |
| TW | 201804501 | A | 2/2018 |
| WO | 2006/070854 | A1 | 7/2006 |

* cited by examiner

LIGHT EMITTING KEYBOARD AND LIGHTING BOARD THEREOF

BACKGROUND OF THE INVENTION

1. Field of the Invention

The present invention relates to a light emitting keyboard and a lighting board thereof, and more specifically, to a light emitting keyboard having a lighting board with silver-paste circuit layers respectively formed on upper and lower surfaces of a flexible substrate and a lighting board thereof.

2. Description of the Prior Art

In general, for providing a keyboard with a light emitting function, a convention design involves directly disposing an LED (light emitting diode) board having light emitting diodes corresponding to keyswitches respectively on a bottom board of the keyboard. Accordingly, the light emitting diode could emit light to the corresponding cap for generating the illumination effect. Furthermore, the aforesaid design could utilize an integrated circuit chip on the LED board to transmit electrical signals for controlling illumination of each light emitting diode such that the keyboard could provide various illumination effects.

However, since the LED board is usually made of expensive curing-resin material for improving the manufacturing yield of LED board, the aforesaid design not only causes the problem that the board thickness of the LED board cannot be reduced easily to be disadvantageous to the thinning design of the keyboard, but also increases the manufacturing cost of the LED board.

SUMMARY OF THE INVENTION

The present invention provides a light emitting keyboard. The light emitting keyboard includes a bottom board, a plurality of keyswitches and a lighting board. The plurality of keyswitches is disposed on the bottom board. Each keyswitch includes a cap and a lifting mechanism. The lifting mechanism is disposed between the bottom board and the cap. The cap is movable upwardly and downwardly relative to the bottom board via the lifting mechanism. The lighting board is disposed between the bottom board and the plurality of keyswitches or under the bottom board. The lighting board includes a flexible substrate, a plurality of multiple-light emitting diodes, a first silver-paste circuit layer, a second silver-paste circuit layer, a via pillar, a copper layer, and a first protection layer. The flexible substrate has at least one first hole. The plurality of multiple-light emitting diodes corresponds to the plurality of keyswitches respectively for generating light to be incident to the plurality of caps. The first silver-paste circuit layer has a plurality of first circuits. The plurality of first circuits is formed on an upper surface of the flexible substrate. The second silver-paste circuit layer has a plurality of second circuits. The plurality of second circuits is formed on a lower surface of the flexible substrate. The via pillar is formed in the at least one first hole to be coupled to at least one of the plurality of first circuits and at least one of the plurality of second circuits. The copper layer is plated on the first silver-paste circuit layer and the second silver-paste circuit layer. The first protection layer is coated on the copper layer. The first protection layer has a plurality of second holes respectively corresponding to the plurality of keyswitches and respectively corresponding to the copper layer plated on the first silver-paste circuit layer. Each multiple-light emitting diode is disposed on the copper layer plated on the first silver-paste circuit layer through the corresponding second hole to be coupled to the plurality of first circuits.

The present invention further provides a lighting board for providing light to a plurality of keyswitches on a keyboard. The lighting board includes a flexible substrate, a plurality of multiple-light emitting diodes, a first silver-paste circuit layer, a second silver-paste circuit layer, a via pillar, a copper layer, and a first protection layer. The flexible substrate has at least one first hole. The plurality of multiple-light emitting diodes corresponds to the plurality of keyswitches respectively for generating light to be incident to the plurality of keyswitches. The first silver-paste circuit layer has a plurality of first circuits. The plurality of first circuits is formed on an upper surface of the flexible substrate. The second silver-paste circuit layer has a plurality of second circuits. The plurality of second circuits is formed on a lower surface of the flexible substrate. The via pillar is formed in the at least one first hole to be coupled to at least one of the plurality of first circuits and at least one of the plurality of second circuits. The copper layer is plated on the first silver-paste circuit layer and the second silver-paste circuit layer. The first protection layer is coated on the copper layer. The first protection layer has a plurality of second holes respectively corresponding to the plurality of keyswitches and respectively corresponding to the copper layer plated on the first silver-paste circuit layer. Each multiple-light emitting diode is disposed on the copper layer plated on the first silver-paste circuit layer through the corresponding second hole to be coupled to the plurality of first circuits.

The present invention further provides a light emitting keyboard. The light emitting keyboard includes a bottom board, a plurality of keyswitches and a lighting board. The plurality of keyswitches is disposed on the bottom board. Each keyswitch includes a cap and a lifting mechanism. The lifting mechanism is disposed between the bottom board and the cap. The cap is movable upwardly and downwardly relative to the bottom board via the lifting mechanism. The lighting board is disposed between the bottom board and the plurality of keyswitches or under the bottom board. The lighting board includes a flexible substrate, a plurality of multiple-light emitting diodes, a first high-conductive circuit layer, a second high-conductive circuit layer, a via pillar, a high-conductive electroplating layer, and a first protection layer. The flexible substrate has at least one first hole. The plurality of multiple-light emitting diodes corresponds to the plurality of keyswitches respectively for generating light to be incident to the plurality of caps. The first high-conductive circuit layer has a plurality of first circuits. The plurality of first circuits is formed on an upper surface of the flexible substrate. The second high-conductive circuit layer has a plurality of second circuits. The plurality of second circuits is formed on a lower surface of the flexible substrate. The via pillar is formed in the at least one first hole to be coupled to at least one of the plurality of first circuits and at least one of the plurality of second circuits. The high-conductive electroplating layer is plated on the first high-conductive circuit layer and the second high-conductive circuit layer. The first protection layer is coated on the high-conductive electroplating layer. The first protection layer has a plurality of second holes respectively corresponding to the plurality of keyswitches and respectively corresponding to the high-conductive electroplating layer plated on the first high-conductive circuit layer. Each multiple-light emitting diode is disposed on the high-conductive electroplating layer plated on the first high-conductive circuit layer through the corresponding second hole to be coupled to the plurality of first circuits.

The present invention further provides a lighting board for providing light to a plurality of keyswitches on a keyboard. The lighting board includes a flexible substrate, a plurality of multiple-light emitting diodes, a first high-conductive circuit layer, a second high-conductive circuit layer, a via pillar, a high-conductive electroplating layer, and a first protection layer. The flexible substrate has at least one first hole. The plurality of multiple-light emitting diodes corresponds to the plurality of keyswitches respectively for generating light to be incident to the plurality of keyswitches. The first high-conductive circuit layer has a plurality of first circuits. The plurality of first circuits is formed on an upper surface of the flexible substrate. The second high-conductive circuit layer has a plurality of second circuits. The plurality of second circuits is formed on a lower surface of the flexible substrate. The via pillar is formed in the at least one first hole to be coupled to at least one of the plurality of first circuits and at least one of the plurality of second circuits. The high-conductive electroplating layer is plated on the first high-conductive circuit layer and the second high-conductive circuit layer. The first protection layer is coated on the high-conductive electroplating layer. The first protection layer has a plurality of second holes respectively corresponding to the plurality of keyswitches and respectively corresponding to the high-conductive electroplating layer plated on the first high-conductive circuit layer. Each multiple-light emitting diode is disposed on the high-conductive electroplating layer plated on the first high-conductive circuit layer through the corresponding second hole to be coupled to the plurality of first circuits.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
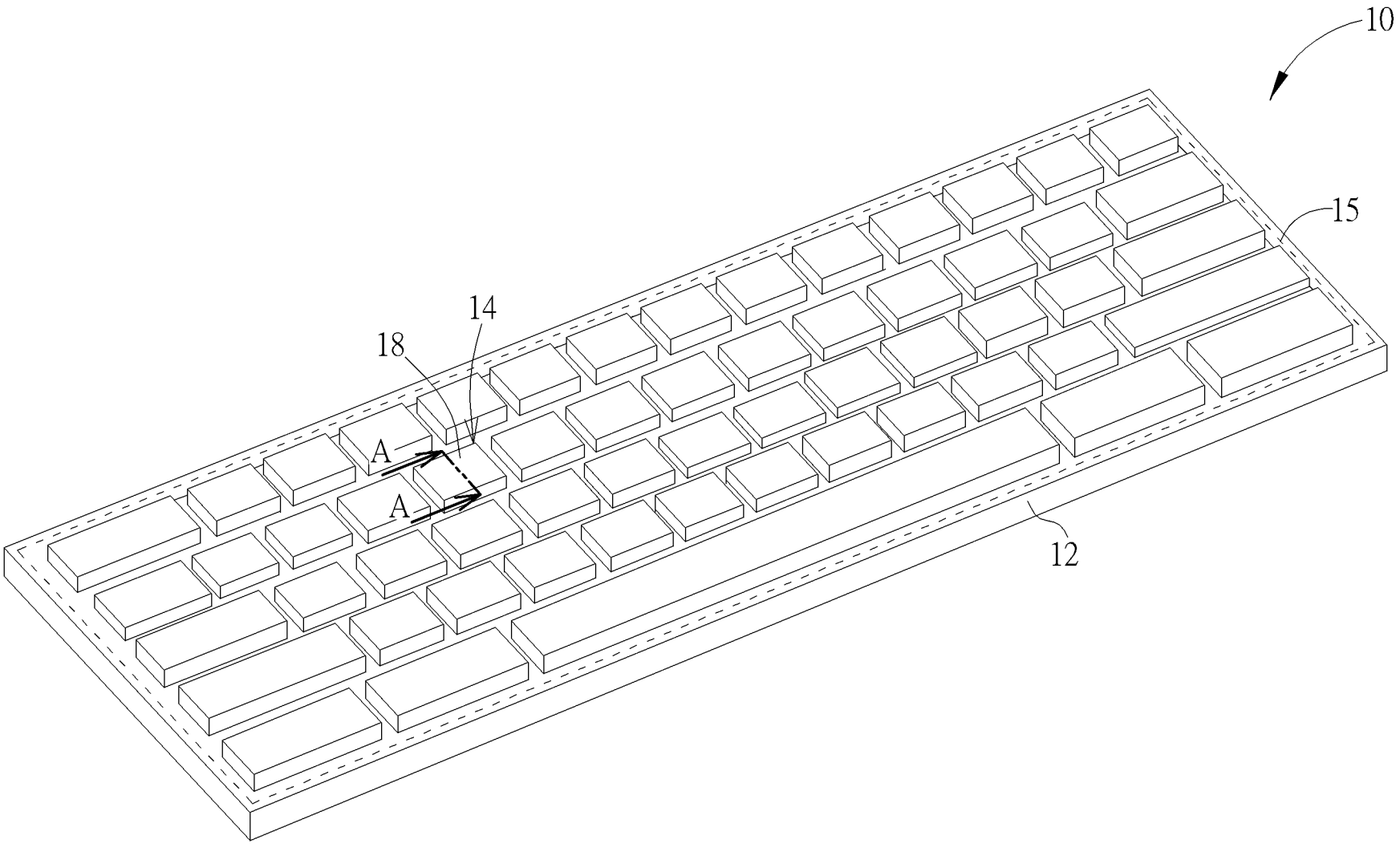
FIG. 1 is a diagram of a light emitting keyboard according to an embodiment of the present invention.
Figure 2:
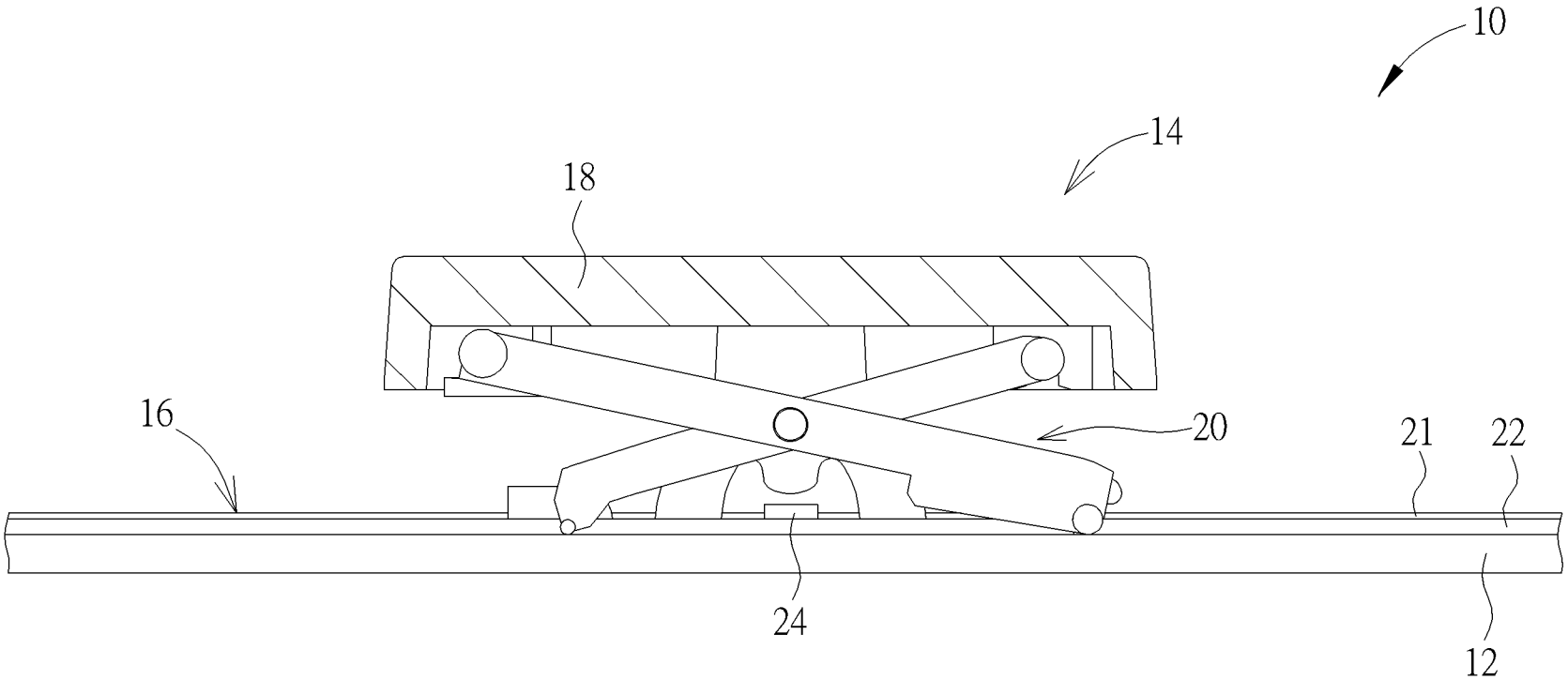
FIG. 2 is a cross-sectional diagram of the light emitting keyboard in FIG. 1.

Please refer to FIG. 1 and FIG. 2. FIG. 1 is a diagram of a light emitting keyboard 10 according to an embodiment of the present invention. FIG. 2 is a cross-sectional diagram of the light emitting keyboard 10 in FIG. 1. As shown in FIG. 1 and FIG. 2, the light emitting keyboard 10 includes a bottom board 12, a plurality of keyswitches 14, and a lighting board 16. The plurality of keyswitches 14 is disposed on the bottom board 12 for a user to press to execute a desired input function. Each keyswitch 14 includes a cap 18 and a lifting mechanism 20. The lifting mechanism 20 is disposed between the bottom board 12 and the cap 18 to make the cap 18 movable upwardly and downwardly relative to the bottom board 12. In this embodiment, the lifting mechanism 20 preferably adopts a scissor supporting design as shown in FIG. 2 (but not limited thereto, meaning that the present invention can adopt other cap lifting designs, such as a magnetic absorption design), and is movably connected to the cap 18 and the bottom board 12. Accordingly, the cap 18 can move upwardly and downwardly relative to the bottom board 12 via the lifting mechanism 20.

Figure 3:
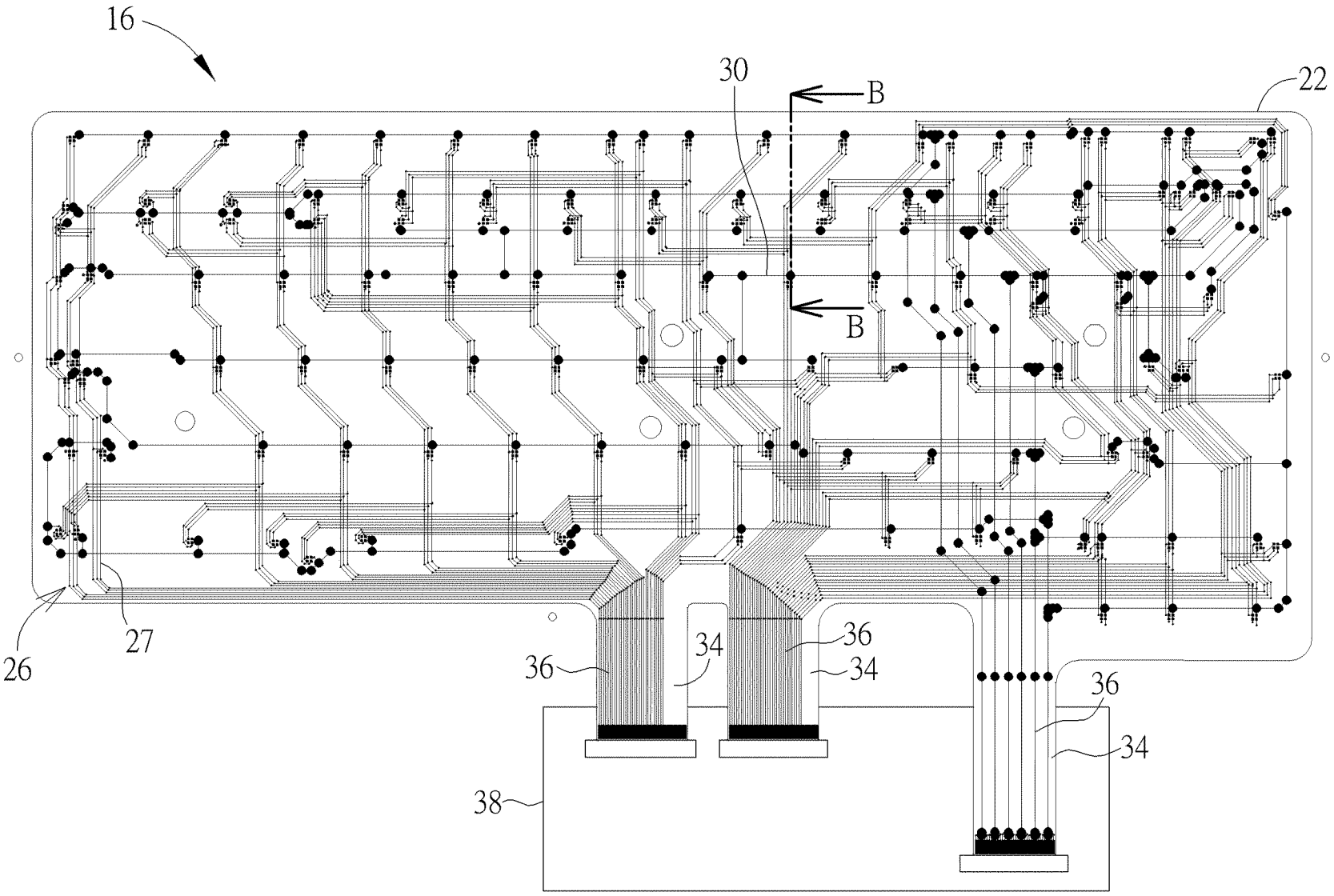
FIG. 3 is an enlarged top view of a lighting board in FIG. 2.
Figure 4:
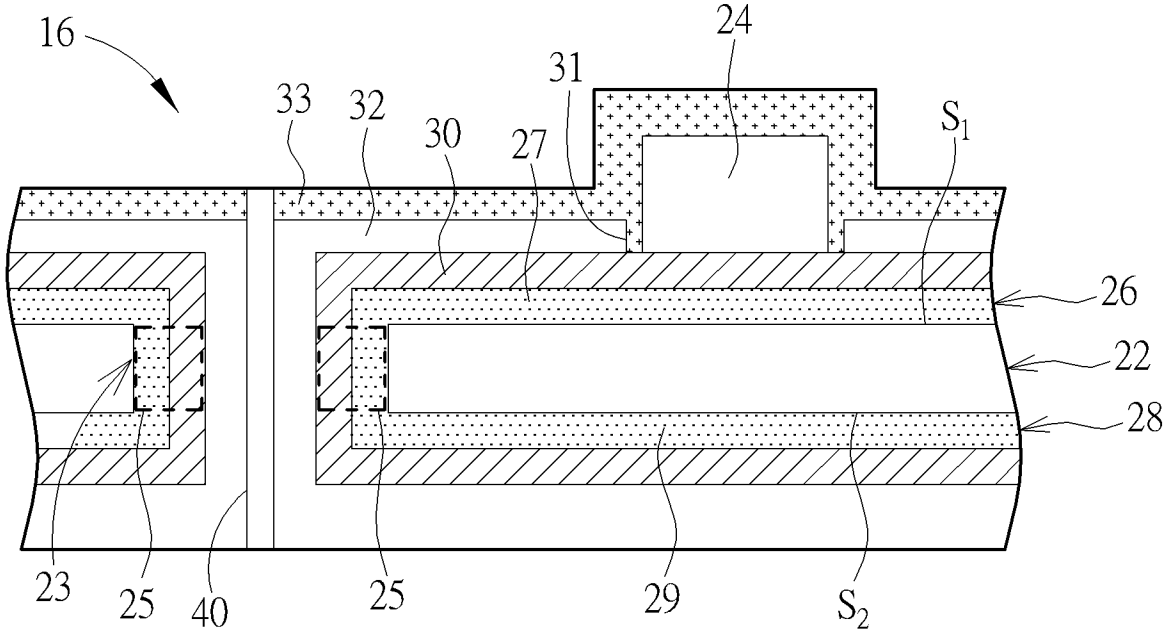
FIG. 4 is a partial cross-sectional diagram of the lighting board in FIG. 3.

As for the lighting design of the lighting board 16, the related description is provided as follows according to FIG. 2, FIG. 3, and FIG. 4. FIG. 3 is an enlarged top view of the lighting board 16 in FIG. 2. FIG. 4 is a partial cross-sectional diagram of the lighting board 16 in FIG. 3. As shown in FIG. 2, FIG. 3, and FIG. 4, the lighting board 16 is disposed on the bottom board 12, and the lighting board 16 includes a flexible substrate 22, a plurality of multiple-light emitting diodes 24, a via pillar 25, a first silver-paste circuit layer 26, a second silver-paste circuit layer 28, a copper layer 30, and a first protection layer 32. The flexible substrate 22 is preferably made of flexible substrate material (e.g. polyethylene terephthalate (PET) or polyimide (PI), but not limited thereto) and has at least one first hole 23 (the number and configuration of the first holes 23 depend on the practical circuit design of the lighting board 16 and are not limited to FIG. 3). The multiple-light emitting diodes 24 are preferably RGB LEDs corresponding to the plurality of keyswitches 14 for emitting light to the caps 18 to generate the illumination effect.

The first silver-paste circuit layer 26 could have a plurality of first circuits 27 (the number and configuration of the first circuits 27 depend on the practical circuit design of the lighting board 16 and are not limited to FIG. 3). The present invention preferably adopts a silver-paste printing process to form the plurality of first circuits 27 on an upper surface $S_1$ of the flexible substrate 22. Similarly, the second silver-paste circuit layer 28 could have a plurality of second circuits 29 formed on a lower surface $S_2$ of the flexible substrate 22. At least one of the plurality of first circuits 27 is electrically connected to at least one of the plurality of second circuits 29 via the via pillar 25 formed in the first hole 23 for establishing electrical connection between the first circuits 27 and the second circuits 29. Furthermore, in this embodiment, the present invention utilizes the copper layer 30 (compared with a silver-paste circuit, a copper circuit has a constant resistance) to be plated on the first silver-paste circuit layer 26 and the second silver-paste circuit layer 28, and the first protection layer 32 is preferably made of UV-curing resin material (but not limited thereto) and coated on the copper layer 30 for preventing oxidization of the copper layer 30.

To be more specific, as shown in FIG. 4, the first protection layer 32 has a plurality of second holes 31 respectively corresponding to the plurality of keyswitches 14 and respectively corresponding to the copper layer 30 coated on the first silver-paste circuit layer 26, and each multiple-light emitting diode 24 is disposed on the copper layer 30 coated on the first silver-paste circuit layer 26 via the corresponding second hole 31 to be electrically connected to the first circuit 27. Accordingly, the lighting board 16 can perform electrical signal transmission via the copper layer 30 (compared with a silver paste circuit, a copper circuit could have a constant resistance) to control illumination and color variation of the plurality of multiple-light emitting diodes 24. In practical application, the lighting board 16 could further include a second protection layer 33. The second protection layer 33 is coated on the first protection layer 32 and each multiple-light emitting diode 24 for generating the ESD (electrostatic Discharge) protection, dustproof, and waterproof effects.

More detailed description for the steps of forming the first silver-paste circuit layer 26, the second silver-paste circuit layer 28, the via pillar 25, and the copper layer 32 on the flexible substrate 22 is provided as follows. As shown in FIG. 4, the first silver-paste circuit layer 26 and the second silver-paste circuit layer 28 are formed on the upper surface $S_1$ and the lower surface $S_2$ respectively by a silver-paste printing process, and the copper layer 30 is plated on first silver-paste circuit layer 26 and the second silver-paste circuit layer 28 (e.g. by an electrochemical plating process). In this process, silver-paste material and copper material cooperatively form the via pillar 25 along the first hole 23 (as shown in FIG. 4, that is, the via pillar 25 is made of copper and silver-paste laminated material in this embodiment), to establish electrical connection between the first circuit 27 and the second circuit 29. Subsequently, the first protection layer 32 is coated on the copper layer 30 by a printing process and has the second hole 31. Accordingly, the multiple-light emitting diode 24 is disposed on the copper layer 30 (e.g. by a soldering process) through the second hole 31 to be electrically connected to the first circuit 27. Finally, the second protection layer 33 is coated on the first protection layer 32 and the multiple-light emitting diode 24 by a printing process, so as to complete the manufacturing process of the lighting board 16. To be noted, as shown in FIG. 4, in the process of sequentially forming the first protection layer 32 and the second protection layer 33 along the first hole 23, a slot hole 40 is formed in the first hole 23 (but not limited thereto, meaning that the present invention could adopt the design in which the first hole 23 is filled with the first protection layer 32 and the second protection layer 33 in another embodiment).

Furthermore, as shown in FIG. 3, at least one cable board portion 34 (three shown in FIG. 3, but not limited thereto) extends outwardly from the flexible substrate 22, and the lighting board 16 could further include a connection circuit layer 36 and a control circuit board 38. The connection circuit layer 36 is formed on the cable board portion 34 and is electrically connected to the plurality of multiple-light emitting diodes 24 via the copper layer 30. The control circuit board 38 is connected to an end of the cable board portion 34 (e.g. by utilizing a cable of the cable board portion 34 to be inserted into a connection port on the control circuit board 38) and is electrically connected to the connection circuit layer 36. Accordingly, the control circuit board 38 can transmit electrical signals to the multiple-light emitting diodes 24 via the connection circuit layer 36 for controlling illumination of the multiple-light emitting diodes 24 (e.g. controlling the multiple-light emitting diodes 24 to emit light periodically or emit light of different colors sequentially, wherein the related description for the circuit design and control principle of the control circuit board 38 is commonly seen in the prior art and omitted herein), so that the light emitting keyboard 10 could have various illumination effects. Furthermore, as shown in FIG. 2, the light emitting keyboard 10 could further include a membrane circuit board 21. The membrane circuit board 21 is disposed on the lighting board 16. In such a manner, when the cap 18 is pressed by an external force, the cap 18 moves downward with the lifting mechanism 20 such that a corresponding membrane switch on the membrane circuit board 21 could be triggered to execute a desired input function. As for the triggering design of the light emitting keyboard 10 (e.g. utilizing a protruding structure on the lifting mechanism 20 to trigger the membrane switch on the membrane circuit board 21), the related description is omitted herein since it is commonly seen in the prior art.

In summary, the present invention adopts the design of forming circuits (i.e. the first silver-paste circuit layer 26, the second silver-paste circuit layer 28, and the copper layer 30) for electrical signal transmission on the upper surface $S_1$ and the lower surface $S_2$ of the flexible substrate 22 respectively and the design of connecting the control circuit board 38 to a side of the flexible substrate 22. Furthermore, as shown in FIG. 1 and FIG. 3, the plurality of keyswitches 14 cooperatively defines a keyswitch region 15, and an area of the flexible substrate 22 is substantially equal to an area of the keyswitch region 15. To be noted, since there are only integrated circuit chips disposed on the control circuit board 38 to control illumination of the multiple-light emitting diodes 24 without any multiple-light emitting diode 24 and signal transmission circuit, an area of the control circuit board 38 is less than the area of the flexible substrate 22. Thus, the present invention not only solves the prior art problem, in which that the board thickness of the LED board cannot be reduced easily to be disadvantageous to the thinning design of the light emitting keyboard, by flexibility of the flexible substrate (an allowable minimum board thickness of flexible board material is less than an allowable minimum board thickness of rigid board material in a practical manufacturing process), but also reduces the manufacturing cost of the light emitting keyboard due to low material cost of the flexible substrate (material cost of flexible board material is less than material cost of rigid board material).

It should be mentioned that in the embodiment that the lighting board 16 does not have the function for controlling illumination of the multiple-light emitting diodes 24 (i.e. the lighting board 16 only has the aforesaid electrical signal transmission function and the function for controlling illumination of the multiple-light emitting diodes 24 is performed by an electronic device (e.g. a notebook) coupled to the light emitting keyboard 10), the control circuit board 38 could be an omissible component for simplifying the circuit board design of the light emitting keyboard 10 and reducing the manufacturing cost of the light emitting keyboard 10. Moreover, in practical application, the control circuit board 38 can be attached under the lighting board 16 by bending the cable board portion 34 of the flexible substrate 22 to reduce space occupied by the lighting board 16. To be noted, the configuration of the control circuit board is not limited to the aforesaid embodiment, meaning that the present invention could adopt the design that the control circuit board is directly attached under the flexible circuit board without the cable board portion and the connection circuit layer to further simplify the circuit board design of the light emitting keyboard. In brief, in the embodiment of omitting the cable board portion and the connection circuit layer, the control circuit board can be directly attached under the flexible circuit board (e.g. by attachment of anisotropic conductive film or by a hot-bar soldering process) to be electrically connected to the multiple-light emitting diodes via the copper layer. Accordingly, the control circuit board can transmit electrical signals to the multiple-light emitting diodes via the copper layer for controlling illumination of the multiple-light emitting diodes.

Figure 5:
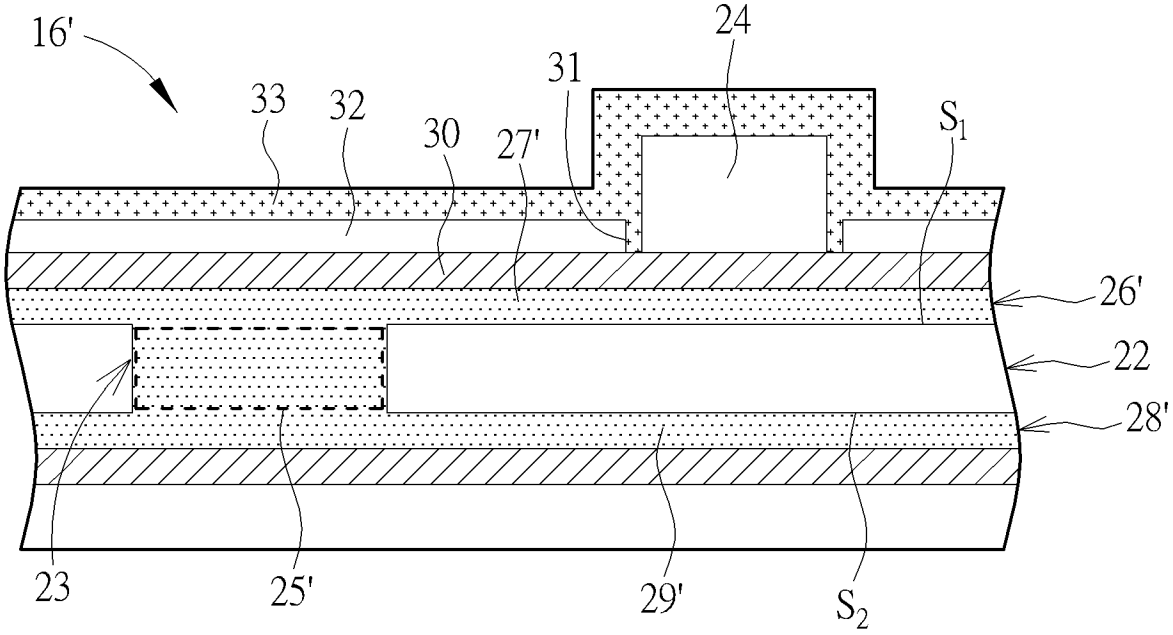
FIG. 5 is a partial cross-sectional diagram of a lighting board according to another embodiment of the present invention.

In addition, the configuration of the copper layer, the first silver-paste circuit layer and the second silver-paste circuit layer is not limited to the aforesaid embodiment. For example, please refer to FIG. 5, which is a partial cross-sectional diagram of a lighting board 16' according to another embodiment of the present invention. Components both mentioned in this embodiment and the aforesaid embodiments represent components with similar structures or functions, and the related description is omitted herein. As shown in FIG. 5, the lighting board 16' includes the flexible substrate 22, the plurality of multiple-light emitting diodes 24 (only one shown in FIG. 5), a via pillar 25', a first silver-paste circuit layer 26', a second silver-paste circuit layer 28', the copper layer 30, the first protection layer 32, and the second protection layer 33. The first silver-paste circuit layer 26' could have a plurality of first circuits 27'. In this embodiment, the present invention preferably adopts a silver-paste printing process to form the plurality of first circuits 27' on the upper surface $S_1$ of the flexible substrate 22. Similarly, the second silver-paste circuit layer 28' could have a plurality of second circuits 29' formed on the lower surface $S_2$ of the flexible substrate 22. To be noted, as shown in FIG. 5, in the process of forming the first circuits 27' and the second circuits 29', the first hole 23 is filled with silver paste (but not limited thereto) to form the via pillar 25', which means the via pillar 25' is made of silver paste material in this embodiment, for establishing electrical connection between the first circuits 27' and the second circuits 29'.

Figure 6:
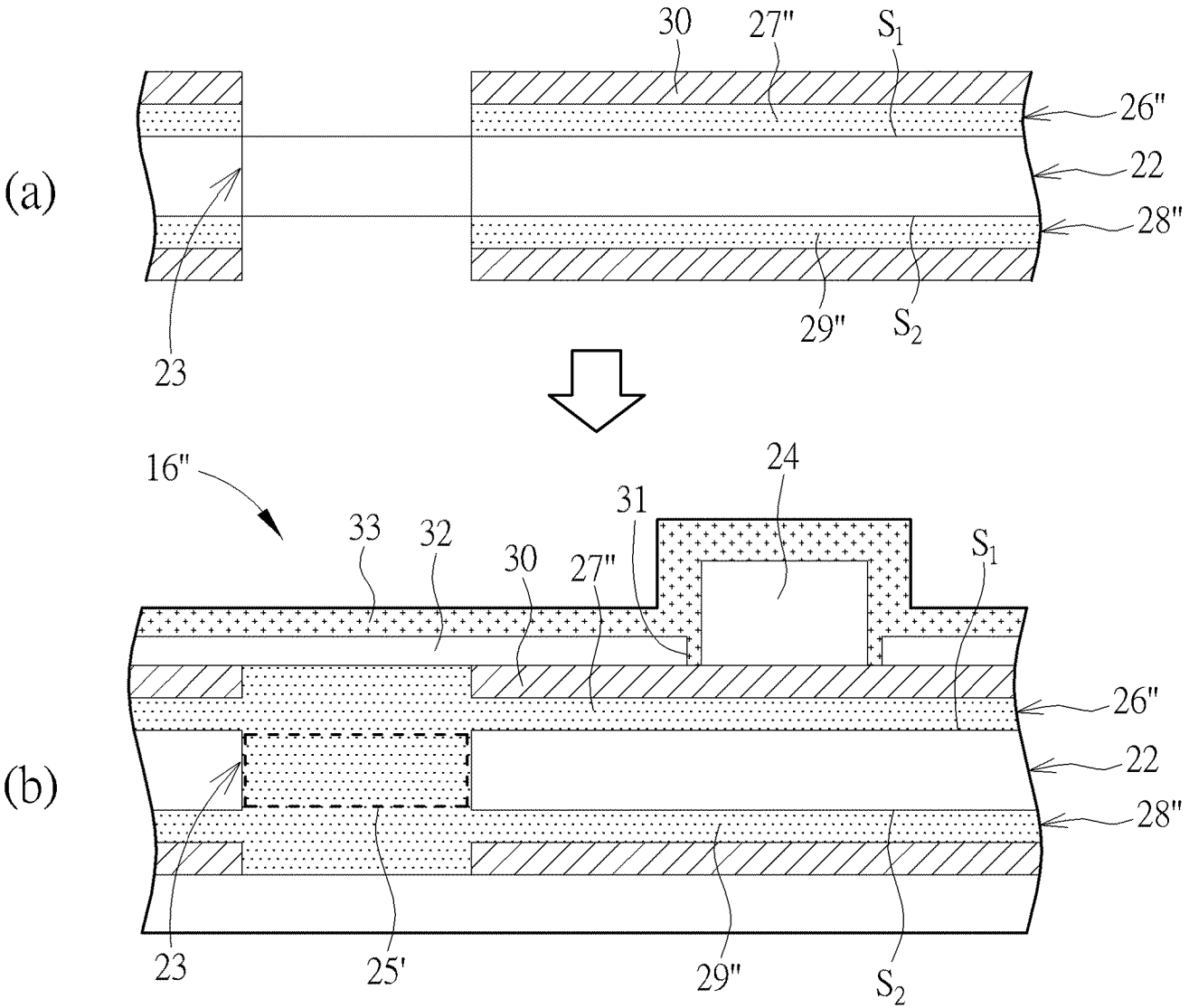
FIG. 6 is a partial cross-sectional diagram of a forming process of a lighting board according to another embodiment of the present invention.

In another embodiment, please refer to FIG. 6, which is a partial cross-sectional diagram of a forming process of a lighting board 16" according to another embodiment of the present invention. Components both mentioned in this embodiment and the aforesaid embodiments represent components with similar structures or functions, and the related description is omitted herein. As shown in FIG. 6, the lighting board 16" includes the flexible substrate 22, the plurality of multiple-light emitting diodes 24 (only one shown in FIG. 6), the via pillar 25', a first silver-paste circuit layer 26", a second silver-paste circuit layer 28", the copper layer 30, and the first protection layer 32. The first silver-paste circuit layer 26" could have a plurality of first circuits 27", and the second silver-paste circuit layer 28" could have a plurality of second circuits 29". As shown in FIG. 6(*a*), in this embodiment, the present invention preferably adopts a silver-paste printing process to form the first circuit 27" and the second circuit 29" on the upper surface $S_1$ and the lower surface $S_2$ of the flexible substrate 22 respectively, and the copper layer 30 is plated on the first silver-paste circuit layer 26" and the second silver-paste circuit layer 28". Subsequently, as shown in FIG. 6(*b*), the aforesaid silver-paste printing process is performed again to make the first hole 23 filled with silver paste, so as to make the first circuits 27" and the second circuits 29" electrically connected to each other via the via pillar 25' for establishing circuit connection of the flexible substrate 22.

Figure 7:
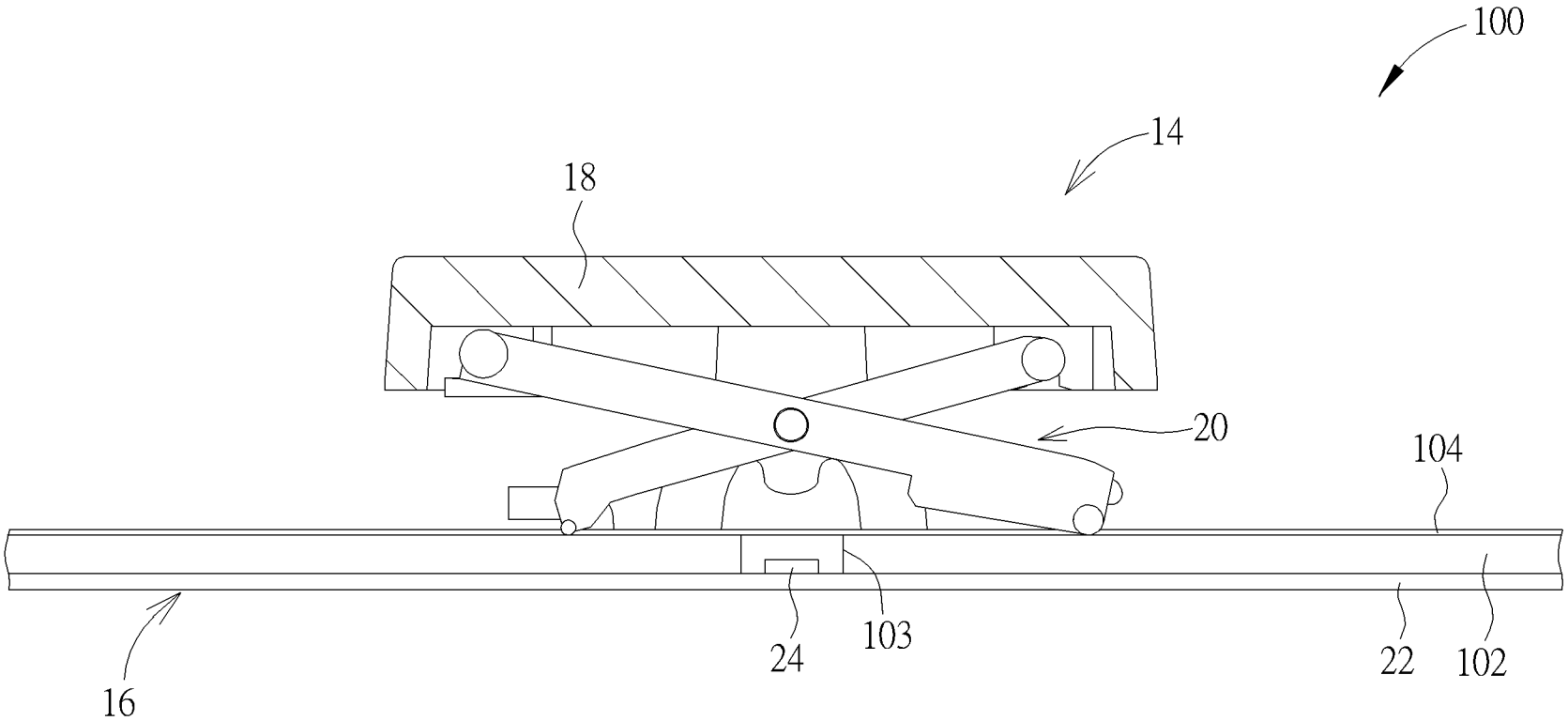
FIG. 7 is a partial cross-sectional diagram of a light emitting keyboard according to another embodiment of the present invention.

Furthermore, the configuration of the membrane circuit board and the lighting board is not limited to the aforesaid embodiments. For example, please refer to FIG. 7, which is a partial cross-sectional diagram of a light emitting keyboard 100 according to another embodiment of the present invention. Components both mentioned in this embodiment and the aforesaid embodiments represent components with similar structures or functions, and the related description is omitted herein. As shown in FIG. 7, the light emitting keyboard 100 includes the plurality of keyswitches 14 (only one shown in FIG. 7), the lighting board 16, a bottom board 102 and a membrane circuit board 104. The membrane circuit board 104 is disposed on the bottom board 102. The lighting board 16 is attached under the bottom board 102 and the multiple-light emitting diode 24 is disposed within a hole 103 of the bottom board 102, so as to efficiently reduce space occupied by the multiple-light emitting diode 24 to be advantageous to the thinning design of the light emitting keyboard 100.

Figure 8:
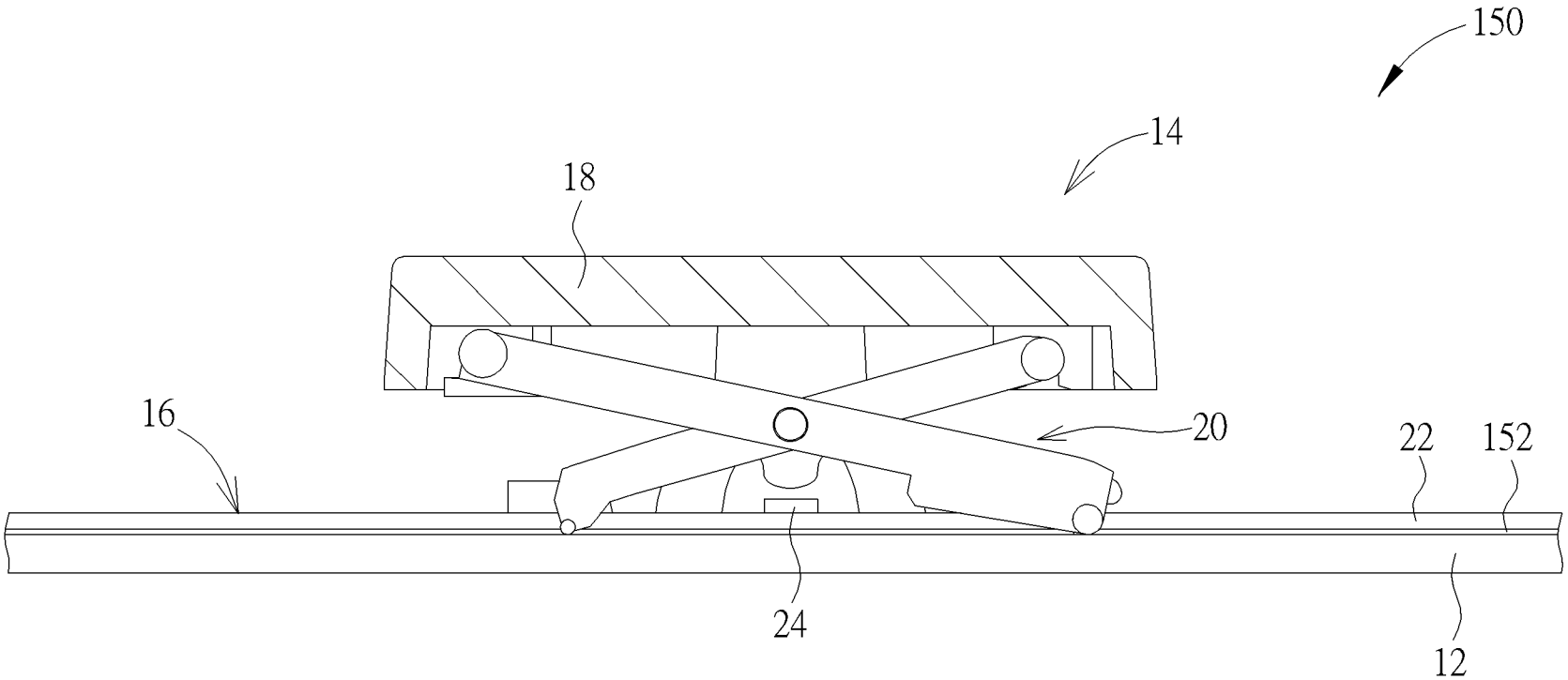
FIG. 8 is a partial cross-sectional diagram of a light emitting keyboard according to another embodiment of the present invention.

In another embodiment, please refer to FIG. 8, which is a partial cross-sectional diagram of a light emitting keyboard 150 according to another embodiment of the present invention. Components both mentioned in this embodiment and the aforesaid embodiments represent components with similar structures or functions, and the related description is omitted herein. As shown in FIG. 8, the light emitting keyboard 150 includes the plurality of keyswitches 14 (only one shown in FIG. 8), the lighting board 16, the bottom board 12, and a membrane circuit board 152. The membrane circuit board 152 is disposed between the bottom board 12 and the lighting board 16. In such a manner, when the cap 18 is pressed by an external force, the cap 18 moves downwardly with the lifting mechanism 20 such that the corresponding membrane switch on the membrane circuit board 152 can be triggered to execute a desired input function.

Figure 9:
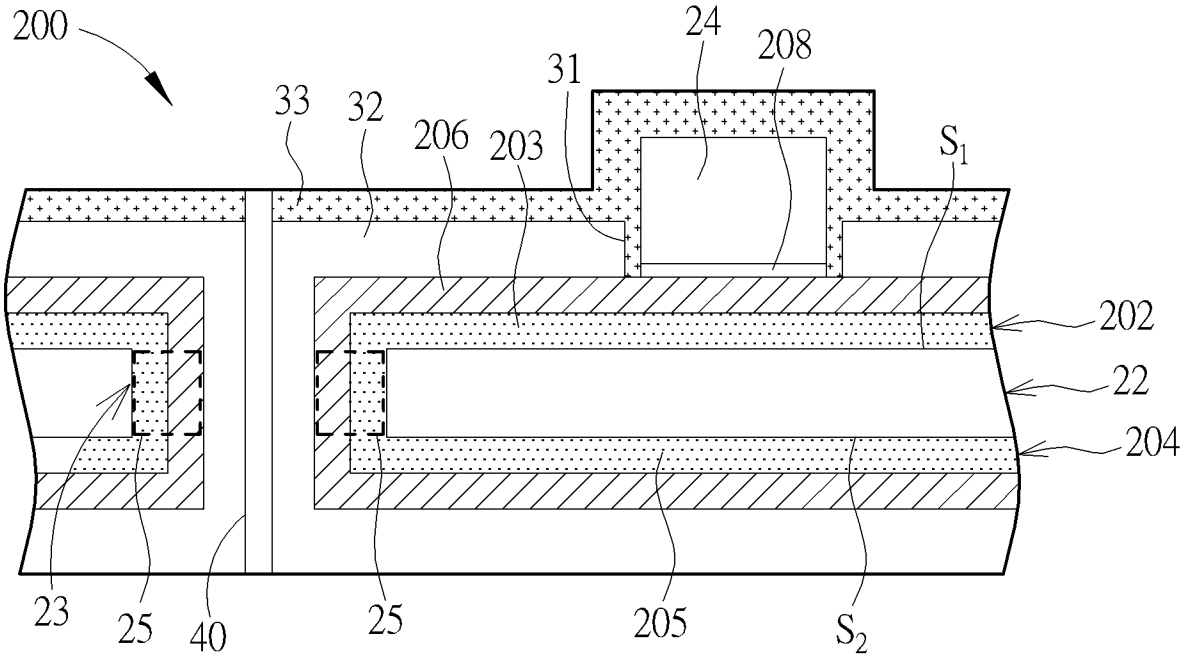
FIG. 9 is a partial cross-sectional diagram of a lighting board according to another embodiment of the present invention.

In another embodiment, the present invention adopts three-layer structural design for electrical connection of the multiple-light emitting diode on the flexible substrate. For example, please refer to FIG. 9, which is a partial cross-sectional diagram of a lighting board 200 according to another embodiment of the present invention. Components both mentioned in this embodiment and the aforesaid embodiments represent components with similar structures or functions, and the related description is omitted herein. The lighting board 200 could be applied to a light emitting keyboard for generating the illumination effect. As shown in FIG. 9, the lighting board 200 includes the flexible substrate 22, the plurality of multiple-light emitting diodes 24 (only one shown in FIG. 9), the via pillar 25, a first high-conductive circuit layer 202, a second high-conductive circuit layer 204, a high-conductive electroplating layer 206, the first protection layer 32, and the second protection layer 33.

In this embodiment, the first high-conductive circuit layer 202 and the second high-conductive circuit layer 204 are preferably made of silver-paste or copper paste material, but not limited thereto. The first high-conductive circuit layer 202 could have a plurality of first circuits 203, and the second high-conductive circuit layer 204 could have a plurality of second circuits 205. The present invention preferably adopts a printing process to form the plurality of first circuits 203 on the upper surface $S_1$ of the flexible substrate 22 and form the plurality of second circuits 205 on the lower surface $S_2$ of the flexible substrate 22. At least one of the plurality of first circuits 203 is electrically connected to at least one of the plurality of second circuits 205 via the via pillar 25 formed in the first hole 23 for establishing electrical connection between the first circuits 203 and the second circuits 205. The high-conductive electroplating layer 206 is preferably made of copper, silver, or nickel material (but not limited thereto) and is plated (e.g. by a chemical electroplating process) on the first high-conductive circuit layer 202 and the second high-conductive circuit layer 204.

Furthermore, in this embodiment, the lighting board 200 could further include an alloy layer 208. The alloy layer 208 is preferably made of tin-bismuth alloy or tin-silver-copper alloy material, but not limited thereto. The alloy layer 208 is formed between each multiple-light emitting diode 24 and the corresponding high-conductive electroplating layer 206 such that each multiple-light emitting diode 24 could be attached on the high-electroplating layer 206 more steadily. As for other related description for the lighting board 200 (e.g. the via pillar design and the control circuit board design), it could be reasoned by analogy according to the aforesaid embodiments and omitted herein.

Figure 10:
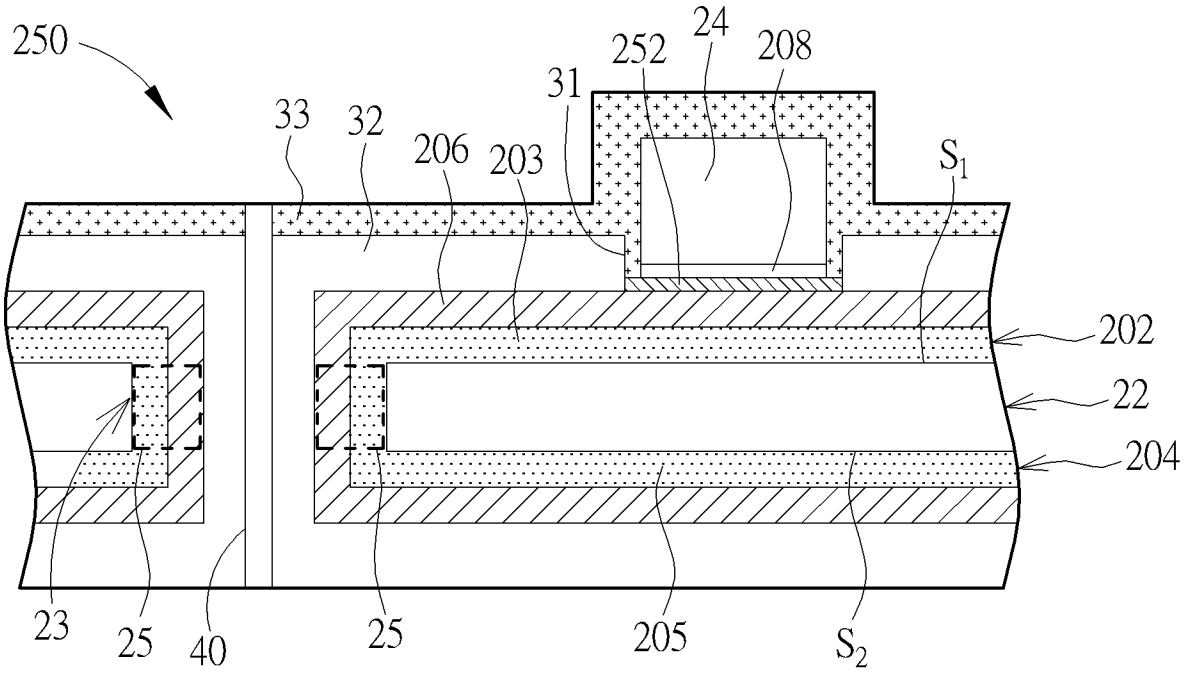
FIG. 10 is a partial cross-sectional diagram of a lighting board according to another embodiment of the present invention.

In another embodiment, the present invention adopts four-layer structural design for electrical connection of the multiple-light emitting diode on the flexible substrate. For example, please refer to FIG. 10, which is a partial cross-sectional diagram of a lighting board 250 according to another embodiment of the present invention. Components both mentioned in this embodiment and the aforesaid embodiments represent components with similar structures or functions, and the related description is omitted herein. The lighting board 250 could be applied to a light emitting keyboard for generating the illumination effect. As shown in FIG. 10, the lighting board 250 includes the flexible substrate 22, the plurality of multiple-light emitting diodes 24 (only one shown in FIG. 10), the via pillar 25, the first high-conductive circuit layer 202, the second high-conductive circuit layer 204, the high-conductive electroplating layer 206, the alloy layer 208, a conductive anti-oxidation layer 252, the first protection layer 32, and the second protection layer 33. In this embodiment, the conductive anti-oxidation layer 252 is preferably made of nickel or gold material, but not limited thereto. The conductive anti-oxidation layer 252 is formed between the high-conductive electroplating layer 206 and the alloy layer 208 for preventing oxidation of the high-conductive electroplating layer 206. As for other related description for the lighting board 250 (e.g. the via pillar design and the control circuit board design), it could be reasoned by analogy according to the aforesaid embodiments and omitted herein.

Figure 11:
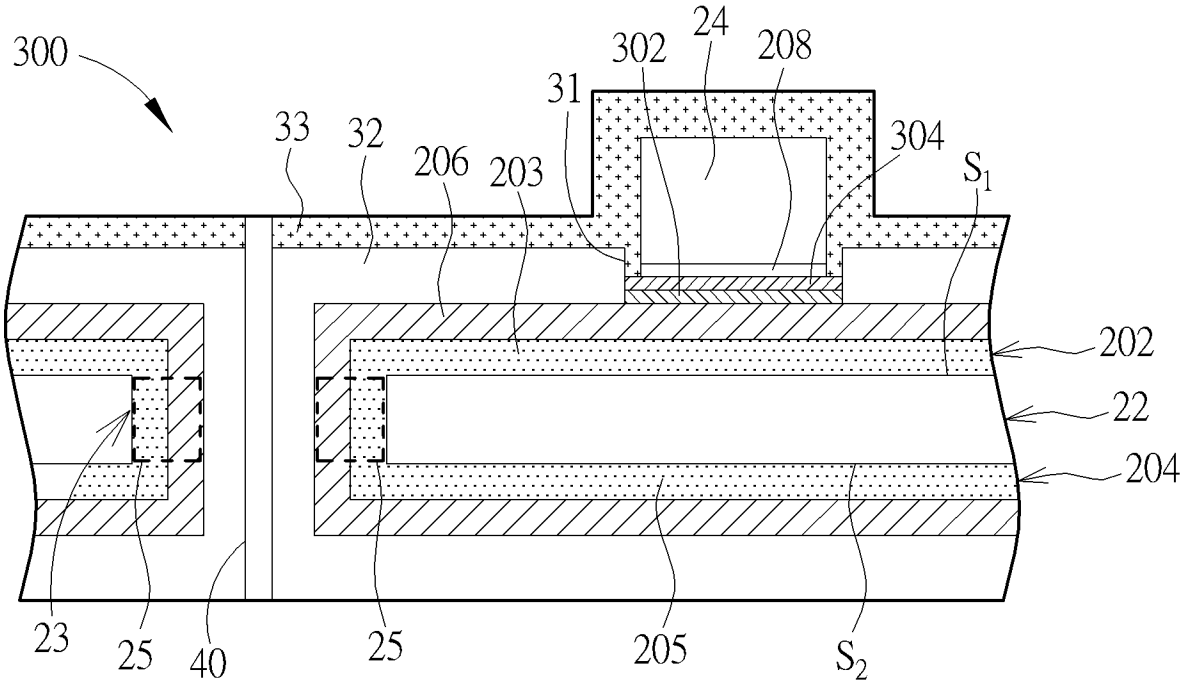
FIG. 11 is a partial cross-sectional diagram of a lighting board according to another embodiment of the present invention.

In another embodiment, the present invention adopts five-layer structural design for electrical connection of the multiple-light emitting diode on the flexible substrate. For example, please refer to FIG. 11, which is a partial cross-sectional diagram of a lighting board 300 according to another embodiment of the present invention. Components both mentioned in this embodiment and the aforesaid embodiments represent components with similar structures or functions, and the related description is omitted herein. The lighting board 300 could be applied to a light emitting keyboard for generating the illumination effect. As shown in FIG. 11, the lighting board 300 includes the flexible substrate 22, the plurality of multiple-light emitting diodes 24 (only one shown in FIG. 11), the via pillar 25, the first high-conductive circuit layer 202, the second high-conductive circuit layer 204, the high-conductive electroplating layer 206, the alloy layer 208, a first conductive anti-oxidation layer 302, a second conductive anti-oxidation layer 304, the first protection layer 32, and the second protection layer 33. In this embodiment, the first conductive anti-oxidation layer 302 is preferably made of nickel material (but not limited thereto) and is formed between the high-conductive electroplating layer 206 and the alloy layer 208, and the second conductive anti-oxidation layer 304 is preferably made of gold material (but not limited thereto) and is formed between the first conductive anti-oxidation layer 302 and the alloy layer 208. In such a manner, via the aforesaid two-layer anti-oxidation design, the present invention can further improve the anti-oxidation effect for the high-conductive electroplating layer. As for other related description for the lighting board 300 (e.g. the via pillar design and the control circuit board design), it could be reasoned by analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting keyboard comprising:

a bottom board;

a plurality of keyswitches disposed on the bottom board, each keyswitch comprising:

a cap; and a lifting mechanism disposed between the bottom board and the cap, the cap being movable upwardly and downwardly relative to the bottom board via the lifting mechanism; and a lighting board disposed between the bottom board and the plurality of keyswitches or under the bottom board, the lighting board comprising:

a flexible substrate having at least one first hole;

a plurality of multiple-light emitting diodes corresponding to the plurality of keyswitches respectively for generating light to be incident to the plurality of caps;

a first silver-paste circuit layer having a plurality of first circuits, the plurality of first circuits being formed on an upper surface of the flexible substrate;

a second silver-paste circuit layer having a plurality of second circuits, the plurality of second circuits being formed on a lower surface of the flexible substrate;

a via pillar formed in the at least one first hole to be coupled to at least one of the plurality of first circuits and at least one of the plurality of second circuits;

a copper layer plated on the first silver-paste circuit layer and the second silver-paste circuit layer; and a first protection layer coated on the copper layer, the first protection layer having a plurality of second holes respectively corresponding to the plurality of keyswitches and respectively corresponding to the copper layer plated on the first silver-paste circuit layer, each multiple-light emitting diode being disposed on the copper layer plated on the first silver-paste circuit layer through the corresponding second hole to be coupled to the plurality of first circuits.

2. The light emitting keyboard of claim 1, wherein at least one cable board portion extends outwardly from the flexible substrate, and the lighting board comprises:

a connection circuit layer formed on the at least one cable board portion and electrically connected to the plurality of multiple-light emitting diodes through the copper layer; and a control circuit board connected to an end of the cable board portion and electrically connected to the connection circuit layer, the control circuit board transmitting electrical signals to the plurality of multiple-light emitting diodes via the connection circuit layer for controlling illumination of the plurality of multiple-light emitting diodes.

3. The light emitting keyboard of claim 2, wherein the control circuit board is attached under the lighting board.

4. The light emitting keyboard of claim 1, wherein the flexible substrate is made of PET (polyethylene terephthalate) or PI (polyimide) material.

5. The light emitting keyboard of claim 1, wherein the first protection layer is made of UV curable resin material.

6. The light emitting keyboard of claim 1, wherein the lighting board further comprises:

a second protection layer coated on the first protection layer and each multiple-light emitting diode.

7. The light emitting keyboard of claim 6, wherein the first protection layer and the second protection layer cooperatively form a slot hole along the at least one first hole.

8. The light emitting keyboard of claim 1, wherein the plurality of keyswitches defines a keyswitch region, and an area of the flexible substrate is equal to an area of the keyswitch region.

9. The light emitting keyboard of claim 1, wherein the via pillar is made of silver-paste material or copper and silver-paste laminated material.

10. The light emitting keyboard of claim 1, wherein the lighting board further comprises a control circuit board, the control circuit board is attached under the flexible substrate to be coupled to the plurality of multiple-light emitting diodes via the copper layer, and the control circuit board transmits electrical signals to the plurality of multiple-light emitting diodes for controlling illumination of the plurality of multiple-light emitting diodes.

11. The light emitting keyboard of claim 1, wherein an alloy layer is formed between each multiple-light emitting diode and the copper layer.

12. The light emitting keyboard of claim 11, wherein the alloy layer is made of tin-bismuth alloy or tin-silver-copper alloy material.

13. The light emitting keyboard of claim 11, wherein a first conductive anti-oxidation layer is formed between each alloy layer and the copper layer.

14. The light emitting keyboard of claim 13, wherein the first conductive anti-oxidation layer is made of nickel or gold material.

15. The light emitting keyboard of claim 13, wherein a second conductive anti-oxidation layer is formed between each alloy layer and the first conductive anti-oxidation layer.

16. The light emitting keyboard of claim 15, wherein the first conductive anti-oxidation layer is made of nickel material, and the second conductive anti-oxidation layer is made of gold material.

17. A lighting board for providing light to a plurality of keyswitches on a keyboard, the lighting board comprising:

a flexible substrate having at least one first hole;

a plurality of multiple-light emitting diodes corresponding to the plurality of keyswitches respectively for generating light to be incident to the plurality of keyswitches;

a first silver-paste circuit layer having a plurality of first circuits, the plurality of first circuits being formed on an upper surface of the flexible substrate;

a second silver-paste circuit layer having a plurality of second circuits, the plurality of second circuits being formed on a lower surface of the flexible substrate;

a via pillar formed in the at least one first hole to be coupled to at least one of the plurality of first circuits and at least one of the plurality of second circuits;

a copper layer plated on the first silver-paste circuit layer and the second silver-paste circuit layer; and a first protection layer coated on the copper layer, the first protection layer having a plurality of second holes respectively corresponding to the plurality of keyswitches and respectively corresponding to the copper layer plated on the first silver-paste circuit layer, each multiple-light emitting diode being disposed on the copper layer plated on the first silver-paste circuit layer through the corresponding second hole to be coupled to the plurality of first circuits.

18. The lighting board of claim 17, wherein at least one cable board portion extends outwardly from the flexible substrate, and the lighting board comprises:

a connection circuit layer formed on the at least one cable board portion and electrically connected to the plurality of multiple-light emitting diodes through the copper layer; and a control circuit board connected to an end of the cable board portion and electrically connected to the connection circuit layer, the control circuit board transmitting electrical signals to the plurality of multiple-light emitting diodes via the connection circuit layer for controlling illumination of the plurality of multiple-light emitting diodes.

19. The lighting board of claim 18, wherein the control circuit board is attached under the lighting board.

20. The lighting board of claim 17, wherein the flexible substrate is made of PET (polyethylene terephthalate) or PI (polyimide) material.

21. The lighting board of claim 17, wherein the first protection layer is made of UV curable resin material.

22. The lighting board of claim 17 further comprising:

a second protection layer coated on the first protection layer and each multiple-light emitting diode.

23. The lighting board of claim 22, wherein the first protection layer and the second protection layer cooperatively form a slot hole along the at least one first hole.

24. The lighting board of claim 17, wherein the plurality of keyswitches defines a keyswitch region, and an area of the flexible substrate is equal to an area of the keyswitch region.

25. The lighting board of claim 17, wherein the via pillar is made of silver-paste material or copper and silver-paste laminated material.

26. The lighting board of claim 17, wherein the lighting board further comprises a control circuit board, the control circuit board is attached under the flexible substrate to be coupled to the plurality of multiple-light emitting diodes via the copper layer, and the control circuit board transmits electrical signals to the plurality of multiple-light emitting diodes for controlling illumination of the plurality of multiple-light emitting diodes.

27. The lighting board of claim 17, wherein an alloy layer is formed between each multiple-light emitting diode and the copper layer.

28. The lighting board of claim 27, wherein the alloy layer is made of tin-bismuth alloy or tin-silver-copper alloy material.

29. The lighting board of claim 27, wherein a first conductive anti-oxidation layer is formed between each alloy layer and the copper layer.

30. The lighting board of claim 29, wherein the first conductive anti-oxidation layer is made of nickel or gold material.

31. The lighting board of claim 29, wherein a second conductive anti-oxidation layer is formed between each alloy layer and the first conductive anti-oxidation layer.

32. The lighting board of claim 31, wherein the first conductive anti-oxidation layer is made of nickel material, and the second conductive anti-oxidation layer is made of gold material.

33. A light emitting keyboard comprising:

a bottom board;

a plurality of keyswitches disposed on the bottom board, each keyswitch comprising:

a cap; and a lifting mechanism disposed between the bottom board and the cap, the cap being movable upwardly and downwardly relative to the bottom board via the lifting mechanism; and a lighting board disposed between the bottom board and the plurality of keyswitches or under the bottom board, the lighting board comprising:

a flexible substrate having at least one first hole;

a plurality of multiple-light emitting diodes corresponding to the plurality of keyswitches respectively for generating light to be incident to the plurality of caps;

a first high-conductive circuit layer having a plurality of first circuits, the plurality of first circuits being formed on an upper surface of the flexible substrate;

a second high-conductive circuit layer having a plurality of second circuits, the plurality of second circuits being formed on a lower surface of the flexible substrate;

a via pillar formed in the at least one first hole to be coupled to at least one of the plurality of first circuits and at least one of the plurality of second circuits;

a high-conductive electroplating layer plated on the first high-conductive circuit layer and the second high-conductive circuit layer; and a first protection layer coated on the high-conductive electroplating layer, the first protection layer having a plurality of second holes respectively corresponding to the plurality of keyswitches and respectively corresponding to the high-conductive electroplating layer plated on the first high-conductive circuit layer, each multiple-light emitting diode being disposed on the high-conductive electroplating layer plated on the first high-conductive circuit layer through the corresponding second hole to be coupled to the plurality of first circuits.

34. The light emitting keyboard of claim 33, wherein the lighting board further comprises:

a second protection layer coated on the first protection layer and each multiple-light emitting diode.

35. The light emitting keyboard of claim 33, wherein the first high-conductive circuit layer and the second high-conductive circuit layer are made of silver-paste or copper-paste material, and the high-conductive electroplating layer is made of copper, silver, or nickel material.

36. The light emitting keyboard of claim 33, wherein an alloy layer is formed between each multiple-light emitting diode and the high-conductive electroplating layer.

37. The light emitting keyboard of claim 36, wherein the alloy layer is made of tin-bismuth alloy or tin-silver-copper alloy material.

38. The light emitting keyboard of claim 36, wherein a first conductive anti-oxidation layer is formed between each alloy layer and the high-conductive electroplating layer.

39. The light emitting keyboard of claim 38, wherein the first conductive anti-oxidation layer is made of nickel or gold material.

40. The light emitting keyboard of claim 38, wherein a second conductive anti-oxidation layer is formed between each alloy layer and the first conductive anti-oxidation layer.

41. The light emitting keyboard of claim 40, wherein the first conductive anti-oxidation layer is made of nickel material, and the second conductive anti-oxidation layer is made of gold material.

42. A lighting board for providing light to a plurality of keyswitches on a keyboard, the lighting board comprising:

a flexible substrate having at least one first hole;

a plurality of multiple-light emitting diodes corresponding to the plurality of keyswitches respectively for generating light to be incident to the plurality of keyswitches;

a first high-conductive circuit layer having a plurality of first circuits, the plurality of first circuits being formed on an upper surface of the flexible substrate;

a second high-conductive circuit layer having a plurality of second circuits, the plurality of second circuits being formed on a lower surface of the flexible substrate;

a via pillar formed in the at least one first hole to be coupled to at least one of the plurality of first circuits and at least one of the plurality of second circuits;

a high-conductive electroplating layer plated on the first high-conductive circuit layer and the second high-conductive circuit layer; and a first protection layer coated on the high-conductive electroplating layer, the first protection layer having a plurality of second holes respectively corresponding to the plurality of keyswitches and respectively corresponding to the high-conductive electroplating layer plated on the first high-conductive circuit layer, each multiple-light emitting diode being disposed on the high-conductive electroplating layer plated on the first high-conductive circuit layer through the corresponding second hole to be coupled to the plurality of first circuits.

43. The lighting board of claim 42 further comprising:

a second protection layer coated on the first protection layer and each multiple-light emitting diode.

44. The lighting board of claim 42, wherein the first high-conductive circuit layer and the second high-conductive circuit layer are made of silver-paste or copper-paste material, and the high-conductive electroplating layer is made of copper, silver, or nickel material.

45. The light emitting keyboard of claim 42, wherein an alloy layer is formed between each multiple-light emitting diode and the high-conductive electroplating layer.

46. The lighting board of claim 45, wherein the alloy layer is made of tin-bismuth alloy or tin-silver-copper alloy material.

47. The lighting board of claim 45, wherein a first conductive anti-oxidation layer is formed between each alloy layer and the high-conductive electroplating layer.

48. The lighting board of claim 47, wherein the first conductive anti-oxidation layer is made of nickel or gold material.

49. The lighting board of claim 47, wherein a second conductive anti-oxidation layer is formed between each alloy layer and the first conductive anti-oxidation layer.

50. The lighting board of claim 49, wherein the first conductive anti-oxidation layer is made of nickel material, and the second conductive anti-oxidation layer is made of gold material.

* * * * *